United States Patent [19]

Arthurs

[11] Patent Number: 4,928,841

[45] Date of Patent: May 29, 1990

[54] BOTTLE TRAY

[75] Inventor: Raymond C. Arthurs, Scarborough, Canada

[73] Assignee: Scepter Manufacturing Company Limited, Don Mills, Canada

[21] Appl. No.: 193,757

[22] Filed: May 13, 1988

[51] Int. Cl.[5] ..... B65D 1/24; B65D 21/02; B65D 71/00; B65D 75/00

[52] U.S. Cl. ..... 220/21; 206/203; 206/427

[58] Field of Search ..... 220/21; 206/203, 427, 206/564, 563

[56] References Cited

U.S. PATENT DOCUMENTS

| | | | |
|---|---|---|---|
| D. 147,981 | 11/1947 | Lehman | D58/13 |
| D. 195,101 | 4/1963 | Fogerty et al. | D58/5 |
| D. 195,702 | 7/1963 | Russo | D58/26 |
| D. 201,257 | 6/1965 | Vidal | D58/5 |
| 2,535,493 | 12/1950 | Gerber . | |
| 2,626,079 | 1/1953 | Keller | 220/21 |
| 2,743,030 | 4/1956 | Read | 220/21 |
| 2,970,715 | 2/1961 | Kappel et al. | 220/21 |
| 3,055,542 | 9/1962 | Russo . | |
| 3,151,762 | 10/1964 | Vidal | 220/21 |
| 3,247,996 | 4/1966 | Garcia | 220/21 |
| 3,297,190 | 1/1967 | Cloyd | 220/21 |
| 3,333,729 | 8/1967 | Rabb . | |
| 3,376,998 | 4/1968 | Cornelius . | |
| 3,812,996 | 5/1974 | Bunnell | 220/21 |
| 3,815,808 | 6/1974 | Bunnell . | |
| 4,095,720 | 6/1978 | Delbrouck | 220/21 |
| 4,344,530 | 8/1982 | deLarosiere | 206/203 |
| 4,700,836 | 10/1987 | Hammett | 220/21 |
| 4,773,554 | 9/1988 | Warwick | 206/427 |

FOREIGN PATENT DOCUMENTS

| | | |
|---|---|---|
| 1207268 | 12/1966 | Fed. Rep. of Germany . |
| 1258689 | 1/1962 | France . |
| 1312701 | 4/1973 | United Kingdom . |

*Primary Examiner*—Stephen Marcus
*Attorney, Agent, or Firm*—Kenyon & Kenyon

[57] ABSTRACT

A plastic tray for the storage, shipping and display of pop bottles. The tray is an open box with pillars attached to the inside bottom of the box. Bottle compartments are thus defined by the box walls and the pillars. The inside of the box walls and pillar sides of each compartment are molded to match the contour of a bottle to be inserted into the compartment. The pillar and box walls are flexible enough to allow the insertion of slightly oversized bottles, but resilient enough to provide a snug fit of each bottle within each compartment.

13 Claims, 5 Drawing Sheets

BOTTLE TRAY

FIELD OF THE INVENTION

This invention relates to trays for holding items such as bottles More particularly, this invention relates to trays used for the shipment and storage of beverage bottles and the like.

BACKGROUND OF THE INVENTION

Bottles and cylindrically shaped vessels are commonly used as containers of various goods for sale in the retail market.

There are inherent disadvantages to bottles and cylindrical containers. For example, they generally have poor stacking characteristics, and cylinders which are much taller than they are wide can be easily tipped and rolled.

The use of large plastic bottles often made of polyethylene terephthalate in the soda pop industry has grown in recent years. Plastic bottles, being more shock and impact resistant than glass, can be more safely used for larger volumes, especially for liquids under pressure.

The systems used in packaging and shipping bottles should allow such bottles to be shipped, stacked, stored and displayed in stores without the need to move the bottles into separate units for each function required.

Certain conventional bottle cases provide a frame which is taller than the bottles. Such cases are provided with internal dividers which minimize bottle contact. They can be stacked to provide convenient storage means for bottles. These cases are heavy, bulky to store and cannot easily be used for display purposes, since they hide the bottles inside. Such cases are still used where display is not important.

A tray has been developed which provides cups for holding the lower portion of a bottle, allowing the remainder of the bottle to be exposed. Such a tray is shown in Canadian patent No. 1,160,603.

Such trays are designed to permit stacking in a grocery store display. However, in order to display the bottle, the cups of such trays rise to only one-third of the bottle height so that the cup does not hold the upper two-third of the bottle.

On the one hand, such cups must snugly fit the bottles to keep the bottles within the tray as the tray is transported and moved along steep inclines in bottle packaging facilities. On the other hand, the bottles must be removable from the tray by consumers when the trays are stacked as a display in the grocery store and they must be able to be drop-packed into the tray by a machine.

Thus the bottles must at one time be held snugly and at the same time be relatively easily placed in and removed from the tray.

The tray of Canadian Patent No. 1,160,603 provides a relatively rigid tray with rigidly fixed cups. In order to provide space for insertion and removal, the cups are made slightly larger than the bottle, and side wall "grippers" are added to the walls of the cups at discrete locations to create a snug fit. This system puts localized pressure on the side wall of a bottle only at discrete locations which is undesirable.

In fact, commercially, Canadian Patent No. 1,160,603 is not in common use with the side wall grippers. Trays are on the U.S. market which are similar to those disclosed the in the Canadian patent. However, such trays are made with cups of exactly the same diameter as the plastic bottles they are designed to hold and therefore with no side wall grippers. The structure of this tray is purposely designed to be rigid to securely hold and grip the lower one-third of the bottle. While this holds the bottles securely, it creates problems inserting and removing such bottles from the tray.

Bottle dimensions vary slightly from bottle to bottle. Under the constant pressure of carbonated contents, large plastic bottles tend to swell. This effect may be exaggerated at elevated temperatures. Thus bottles which are even slightly oversize can severely bind in rigid tray.

SUMMARY OF THE INVENTION

This invention provides a bottle tray for use in storing and shipping bottles in which the bottle receiving compartments are purposely made resilient and flexible to allow for a snug yet removable fit which can be loaded by machinery, shipped, displayed and yet removed by hand by a customer at a display site.

The invention further provides a tray into which can snugly fit large plastic bottles, the fully loaded tray forming a stable shippable and stackable unit.

The invention provides a lightweight resilient and compact tray.

The bottle compartments of trays within this invention have resilient walls. The walls have enough "give" to allow a bottle which is slightly larger in diameter than the diameter of a compartment to fit into the compartment, but which are resilient enough to provide a snug fit for each bottle within the compartment.

The invention further provides trays which may accommodate bottles of a small variation in size.

The invention provides a tray for holding bottles, the tray being comprised of a box with an open top, resilient side walls and at least one pillar, each such pillar being resiliently attached in a free-standing manner to the bottom of the box.

A particular embodiment of the invention provides a tray which can be used to hold up to four bottles. The invention provides a tray of unitary construction, comprising a box with a base, four side walls and an upright pillar located centrally of the base. The pillar and side walls locate and space apart bottles loaded in the tray. The tray is formed of resilient material, such as plastic. Further, the space provided by the pillar and side walls for each bottle is slightly smaller than the space occupied by a an unloaded bottle. The tray construction permits the pillar and side walls of a compartment to flex when such an oversized bottle is inserted into the compartment. However, such pillar and side walls are inherently biased towards returning to the positions they had when the tray was empty. This causes a grip on the bottle, which tends to hold the bottle in place. As each bottle is inserted the deflection of the pillar is corrected by a countervailing pressure from a bottle on another side of the pillar causing the tray to more snuggly grip all the bottles. Thus when the second bottle is inserted, an even tighter fit is provided for it, as the pillar is slightly displaced by it. Thus, the snugness of the fit of the first bottle in the loaded presence of the second bottle is increased, and the snugness of fit of the second bottle is greater than that of the first bottle alone. The addition of a third bottle likewise increases the snugness of the fit of each of the bottles in a tray. A maximum snugness of fit of each bottle is thus reached when the tray is fully loaded with four bottles. That is, the pillars and side walls of respective adjacent tray compartments cooperate to provide a snug fit for loaded bottles.

The quality of fit of a bottle within a given compartment depends in large measure on the amount of friction between abutting walls. It has been found for a particular embodiment to be used with two liter cylindrically round bottles that a suitably snug fit is achieved when the radius of free-standing empty bottle is about equal to that of the radius of an empty compartment of an empty tray. A degree of swelling sometimes occurs upon filling of the bottle. Over a period of time as the bottle sits this may produce a sufficiently oversized bottle. It is also contemplated that a slightly oversized bottle would also work with certain embodiments of this invention.

Certain embodiments of this invention provide a bottle tray wherein each bottle compartment is defined by side walls of the tray and pillars. Pillars are free-standing, that is, structurally connected to the bottom of the tray. A tray is constructed of resilient material such as plastic and each bottle compartment, defined as described herein can thus snugly accommodate bottles within a small range of size. The shape of each compartment of the tray is matched to, but slightly smaller than a bottle to be inserted into the compartment. Structural attachment of a pillar at its base permits it to "give" slightly when an oversized bottle is inserted into a compartment partially defined by it.

According to this invention, trays which can accommodate a maximum number of two or more bottles may be constructed. It is contemplated, for example, that a tray accommodating only two bottles could be constructed. It is further contemplated that a tray for three bottles, wherein three bottle compartments are arranged about a central pillar, could be constructed.

The preferred embodiment provides a tray with a rectangular base in which a maximum of eight bottles may be loaded in two rows of four bottles per row.

The preferred embodiment also provides a tray with an underside exterior molded with female portions located to accept the tops of bottles loaded in an underlying tray as male counterparts in stacking of loaded trays.

The preferred embodiment is molded from a suitably resilient and flexible material such as polyethylene.

In preferred embodiments for use with bottles having lower portions which are cylindrical, pillars are preferably about $\frac{1}{3}$ the height of a bottle. The pillars have side surfaces of arcuate horizontal section, which when a bottle is in its tray compartment, abut side wall portions of the bottle. Each arcuate section of a pillar is preferably about 1/7 the circumference of the bottle portion which it abuts.

Certain embodiments of the invention provide an inner wall of the box which is arcuate in horizontal section and which, when a bottle is in its tray compartment, abut the side wall of the bottle. Each such arcuate section can be from about 1/10 to $\frac{1}{2}$ the circumference of the bottle surface portion abutting the side wall. In the preferred embodiment in which there are two rows of four bottles, four bottles are in row end positions, and four bottles are between row end positions. Bottles at row ends are thus at the corners of a rectangular tray base and the arcuate section of the inner side wall extends about $\frac{1}{2}$ the circumference the bottle portion which it abuts. The four bottles located between corner bottles have inner wall sections extending about $\frac{1}{4}$ the circumference of the bottle abutting portion.

In certain embodiments each pillar is of a generally hollow reinforced construction. A pillar for location between four bottles is formed with interior walls which tend to distribute and disperse forces exerted on the bottle wall across the entire bottle wall abutting such surfaces.

There are many pillar constructions within the scope of this invention. That is, there are several ways of obtaining the desired resiliency characteristics in addition to the pillar construction of the preferred embodiment described hereinbelow.

Certain embodiments provide means to enhance the upright stability of bottles within compartments provided by the tray. For example, certain currently commercially available bottles have "petaloid" bottoms. Such bottle bases have female portions, which accept and abut suitably dimensioned compartment bottom male portions thereby limiting lateral movement of the bottle within the compartment. The upright stability of a bottle may be enhanced by the limitation on the movements of the base of a bottle.

Certain embodiments of the invention are described, without limiting the invention thereto, reference being made to the accompanying drawings, wherein.

DETAILED DESCRIPTION OF A PREFERRED EMBODIMENT

Figure 1:
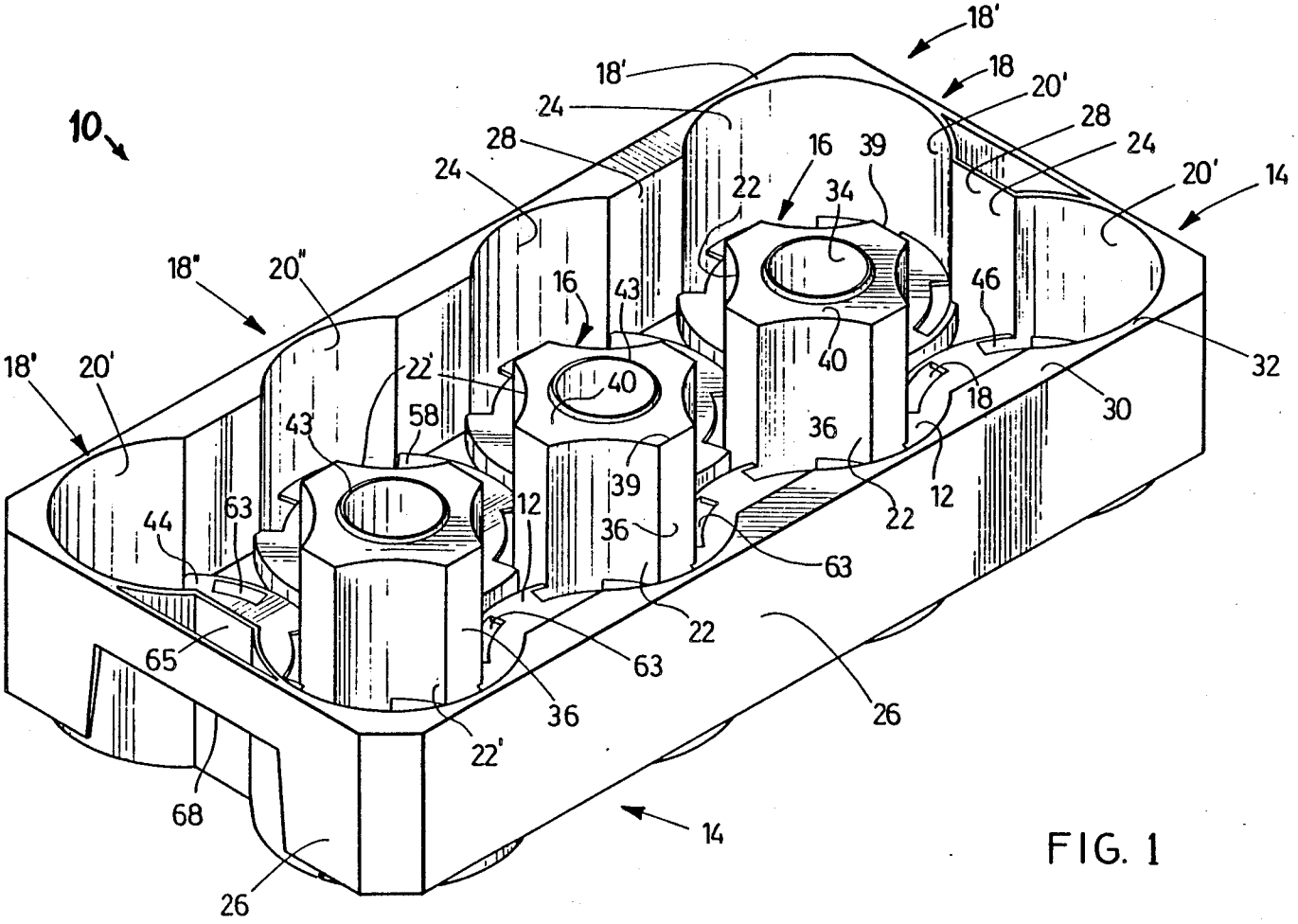
FIG. 1 is a perspective view of a preferred embodiment.

In FIG. 1 is illustrated a preferred embodiment of the invention, tray 10 which accommodates eight bottles, not illustrated. The preferred embodiment is injection-molded from polyethylene, which under temperate conditions gives a suitably resilient tray 10. Other plastics, or the like can be chosen to optimize the desired resiliency characteristics as dictated by the general conditions in which the tray is to be used.

Tray 10 has a bottom 12, walls 14, and three pillars 16. Tray 10 is generally divided into eight bottle compartments 18.

Each corner compartment 18' is partially bound by inner wall cylindrical segment 20 and pillar side wall cylindrical segment 22'. Each inner compartment 18'' is partially bound by inner wall cylindrical segment 20'' and two pillar side wall cylindrical segments 22''.

Box side walls 14 are formed generally of inner wall 24 and outer wall 26. Inner wall cylindrical segments 20 are connected by inner flat wall segments 28. Outer wall 26 and inner wall 24 are connected at the top by wall roof 30. Inner wall 24 and outer wall 26 merge into each other at portions 32.

Figure 3:
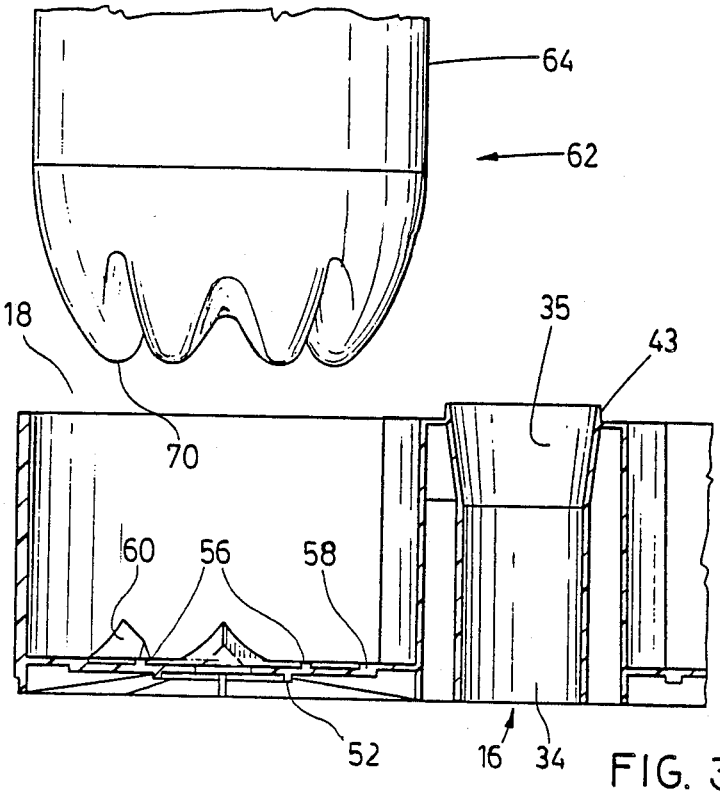
FIG. 3 is a cross-section of the preferred embodiment along 3—3 of FIG. 2.
Figure 5:
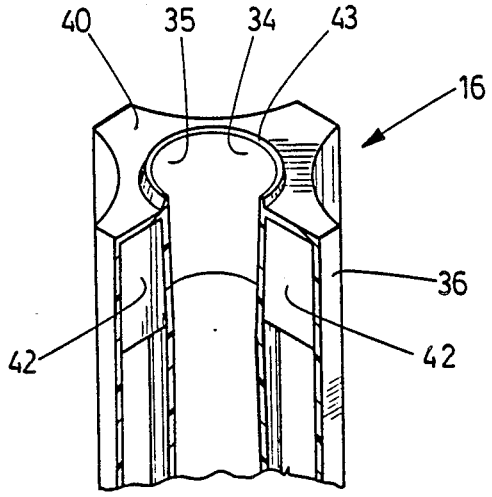
FIG. 5 is a perspective view of a pillar of a preferred embodiment with a partial cutaway.

Pillar 16 is best seen in FIG. 3 and the cut-away view in FIG. 5. Centrally located of each pillar 16 is inner cylinder 34. Cylinder 34 has conical bevel 35 forming its upper portion. Outer pillar cylindrical segments 22 are connected by pillar flat wall segments 36. The eight-sided cylinder 39 formed by connected side segments 22, 36 is concentrically arranged about inner cylinder 34. The tops of each cylinder 34 and 39 are connected by cylinder roof 40. Connecting the walls of inner cylinder 34, flat segments 36, and roof 40 are strut-like members 42. Strut-like members 42 extend downwardly from the roof 40 about half the total height of cylinder 34. Inner cylinder 34 extends slightly upwardly of roof 40 to provide circular flange 43.

There are many pillar constructions within the scope of this invention. For example, the flexibility of the pillar would be increased if pillar roof 40 were absent. The rigidity of a pillar would be increased by the inclusion of reinforcement members in addition to strut-like members 42.

Figure 2:
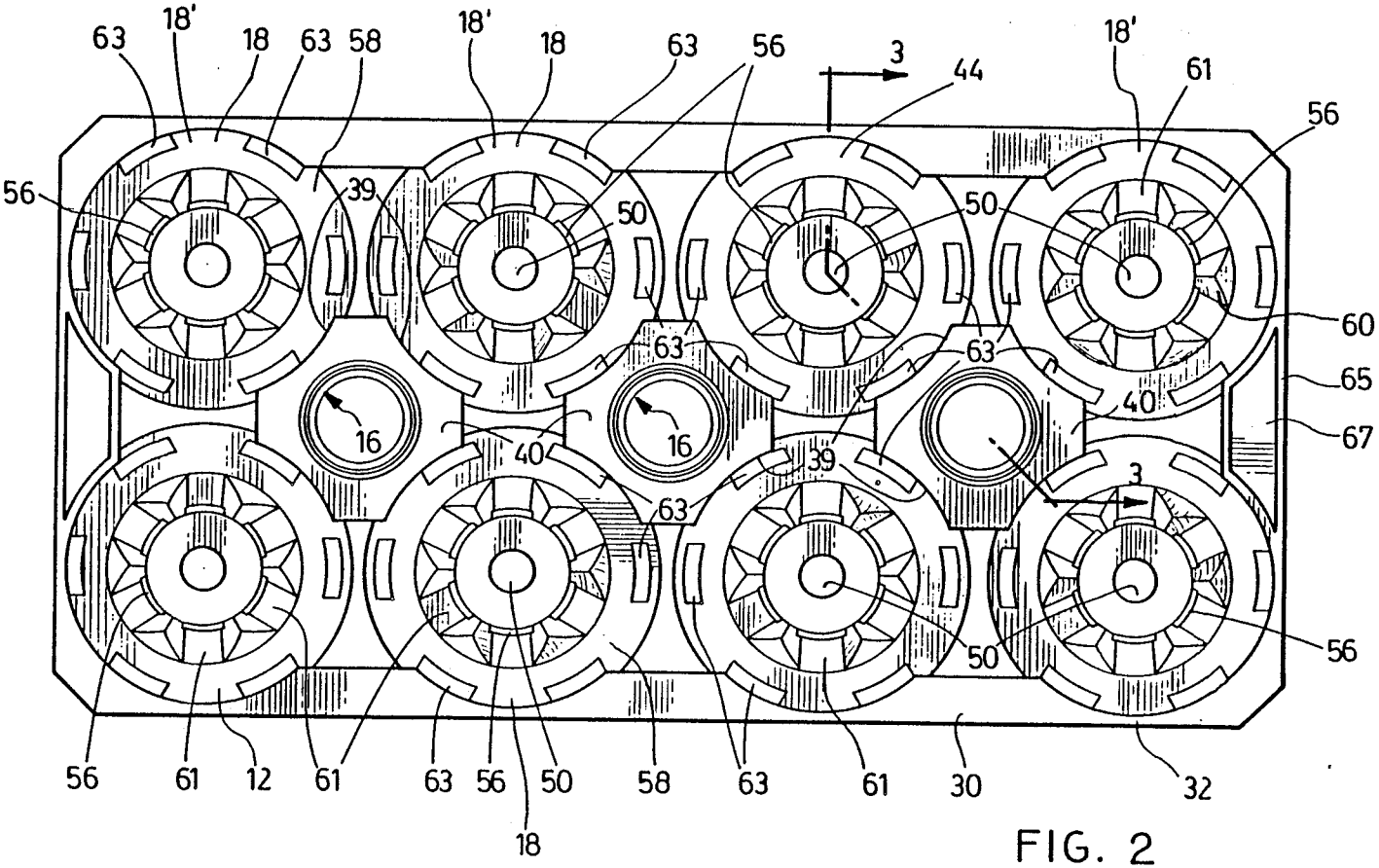
FIG. 2 is top elevational view of a preferred embodiment.
Figure 6:
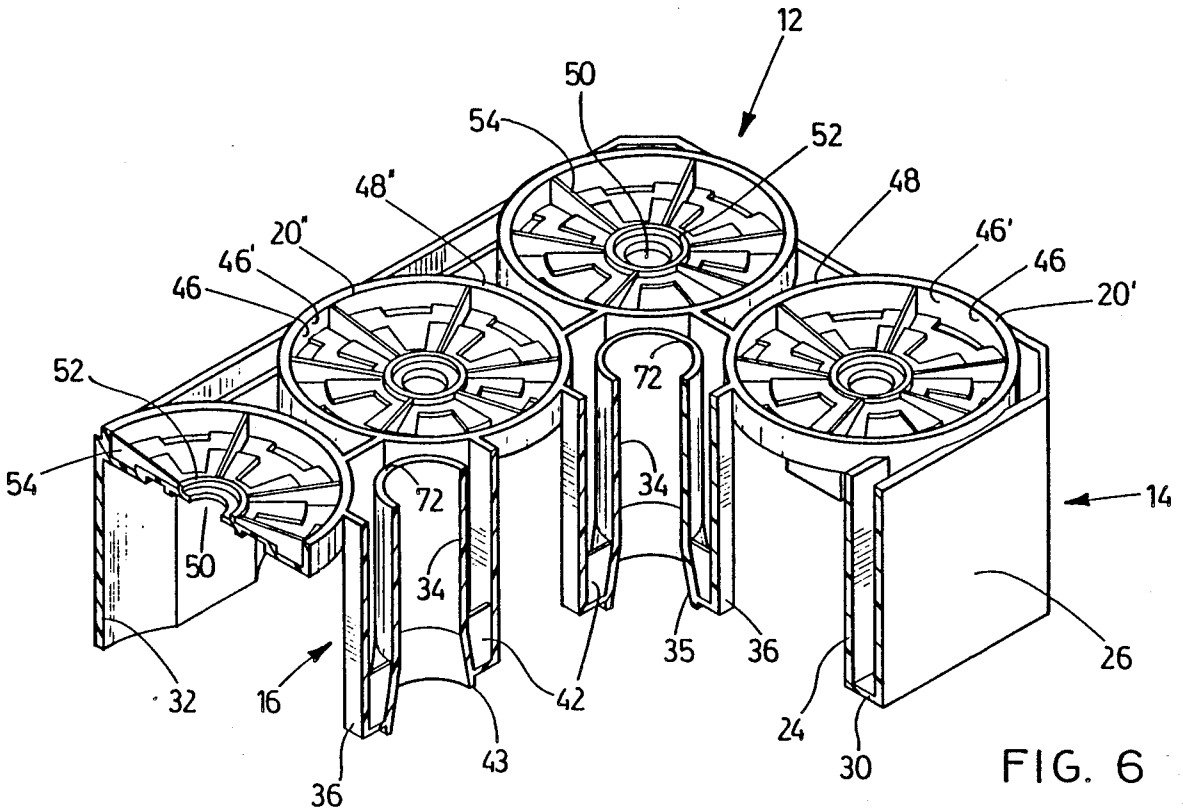
FIG. 6 is a partial perspective view of the bottom of a tray.

The somewhat open framework of tray bottom 12 can be seen in FIGS. 2 and 6. Each compartment bottom 44 is encircled by collar 46. The collar arc segments 48' of compartment 18' extend between wall segments 20' and 22', the combined segments 48', 20', 22' forming a complete circular collar 46'. The collar segments 48" of a compartment 18" extend between wall segments 20" and 22", the combined segments 48", 20", 22" forming a complete circular collar 46". Cylindrical wall segments 20, 22 extend in a generally upright manner from circular collar 46 and are thus concentric about the vertical axis extending from the center of collar 46 and have similar radii of curvature.

Central to each circular collar 46 is circular aperture 50. Spaced radially outwardly of aperture 50. On the underside of compartment bottom 44 is lower circular rib 52. Extending radially outwardly of rib 52 to outer collar 46 are tapered vanes 54. Spaced radially outwardly of rib 52 and o the top side of comPartment bottom 44 is upper circular rib 56. The height of upper circular rib 56 and the height of outer upper bottom 58 are the same. Located between upper rib 56 and outer upper bottom 58 and circumferentially spaced and centrally located between tapered vanes 54 are tricuspids 60. Located circumferentially between tricuspids 60 are floor bottom portions 61, the height of which is slightly less than that or outer upper bottom 58 and upper circular rib 56. Six circumferentially spaced peripheral apertures 63 are provided in compartment bottom 44.

Handle portions 65 are provided at the ends of tray 10. A connecting member 67 connects lower edge 68 of outer wall 26 to the inner wall 24.

Top surfaces of each pillar roof 40, side walls 20, 22, 28, 36 are rounded or chamferred to assist smooth entry of bottles into the bottle receiving compartments 18.

The preferred embodiment is intended for use with bottles having a generally circular cylindrical shape such as bottle 62. As such, the radius of cylindrical segments 20, 22 is slightly smaller than that of the bottle radius of curvature extending from the central axis of the bottle to the outer circumference of the bottle wall 64.

When a bottle which matches, for instance corner compartment 18' is loaded into compartment 18., portions of the bottle sidewall and the compartment side walls abut. That is, portions of the pillar side walls 22 and box inner side walls 20' abut with portions of bottle side walls. Pillar 16 is freestanding and resiliently attached to the bottom of the tray. If the bottle which matches the compartment is oversized, the pillar will flex to accommodate its presence. Because the pillar is freestanding, that is, structurally supported at its base and because the pillar is resiliently attached it can bend slightly in response to the insertion of a so oversized bottle into the compartment 18'. The compartment wall 20' is also resilient and may also flex when a bottle is inserted into the compartment.

Insertion of a first bottle into a first empty compartment causes a slight displacement of cylindrical wall segments 20, 22 and of pillar 16. A snug fit of the first bottle within the first compartment is thus achieved, the snugness resulting from the friction between the abutting surface portions of tray walls 20, 22 and bottle wall 64. The slight displacement of tray walls caused by insertion of a first bottle also reduces slightly the size of other tray compartments, and in particular those compartments adjacent the first compartment.

Thus, in a manner similar to that described for insertion of the first bottle, insertion of a second bottle into a second compartment, adjacent the first compartment, results in a snug fit of the second bottle. Insertion of the second bottle, which impinges on the pillar interposed the two bottles in a manner counter to that of the first bottle thus increases the snugness of the fit of the first bottle. The snugness of the fit of the second bottle is, similarly, greater than that of the first bottle alone in the tray.

Likewise, it can be seen that a maximal snugness of fit for each inserted bottle is reached when eight bottles, the tray limit, have all been inserted into the tray. That is, a synergistic effect is achieved with subsequent addition of bottles. Each bottle fits more snugly into its compartment when adjacent compartments also contain bottles than when adjacent compartments are empty.

Figure 4:
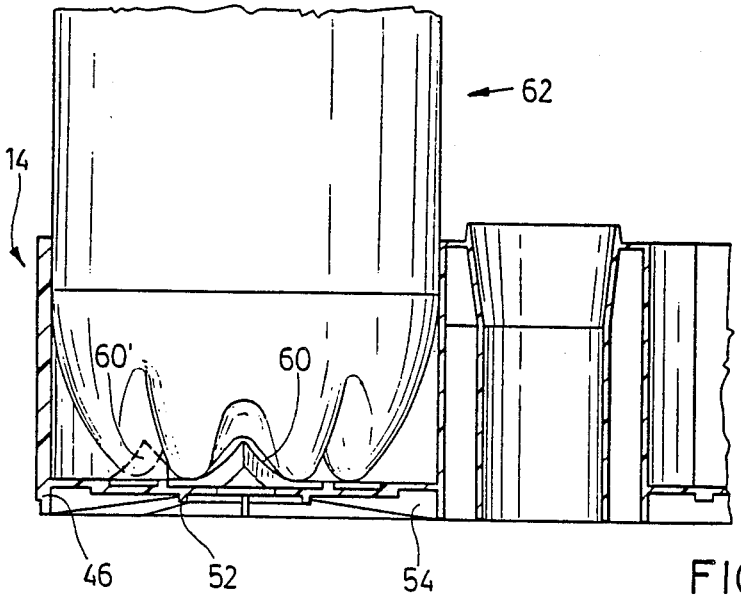
FIG. 4 is the cross-section of FIG. 4 in which a bottle is shown in a tray compartment.

Tray 10 of the preferred embodiment is provided with tricuspids 60, for use with currently available plastic two liter bottles having "petaloid" bottoms. Petals 70 of bottle 62 can be seen in FIG. 3. Tricuspid 60', interposed between petals, (hidden) can be seen in FIG. 4. It is contemplated that compartment bottom surface features, which act to reduce lateral movement of a bottle within a compartment, can be tailored for use with bottles having bottle bottom indentures and the like different from petaloid bottoms.

A first empty tray 10 can readily stack in aligned manner on a second empty tray 10. Respective circular flanges 43 of the second tray nest around the bottom portions of the lower rim 72 of the respective inner cylinders 34 stack directly above. Trays 10 of the preferred embodiment can also be "cross-hatched" in stacking. That is, a first pair of trays laid lengthwise side-by-side can be stacked lengthwise perpendicularly atop a second set of similarly paired trays.

A first tray 10 can be stacked atop a second, loaded tray, the trays in aligned orientation. In such a stacking relation, respective female cavities 74 provided by lower circular ribs 52 and the underside of compartment bottom 44 accept respective soda pop bottle tops (not shown) as female members. In a manner similar to that described for empty trays, loaded trays may be stacked in "cross-hatched" style.

Trays may be made according to this invention to accommodate any number of bottles. For example, a tray to be used for carrying twenty-four ten ounce bottles comprising four rows of six bottles could be made. In such an instance, bottles located in the central part of the tray would abut four pillars.

It is further contemplated that compartment side walls can be shaped to complementally fit irregularities such as ribs formed into bottle side walls.

It will of course be understood that the present invention has been described above purely by way of example, and modifications of detail can be made within the scope of the invention as defined in the appended claims.

I claim:

1. A tray for holding bottles having cylindrically round lower portions comprising:

a generally rectilinear box with an open top, a bottom and resilient side walls;

at least one free-standing upright pillar, the base of the pillar resiliently attached to the interior bottom of the box;

wherein each such pillar is located to be interposed between adjacent bottles whereby the tray is divided into circular bottle receiving compartments formed from the pillar and the resilient side walls;

wherein each such pillar is placed along a line parallel to a longitudinal box side whereby the box is divided into two or more rows, each having a plurality of compartments;

wherein each such pillar and resilient side walls provide curved surfaces which match the side walls of a bottle to be received therein such that the side walls of each pillar have surface portions of arcuate horizontal section spaced around the perimeter of the pillar, the sidewalls of the box have surface portions of arcuate horizontal section, and respective curved surfaces of each compartment are concentrically arranged about and equally spaced from a central upright axis of said compartment;

wherein each pillar further comprises an upright, hollow inner cylinder wherein a pillar roof connects the pillar side walls and inner cylinder; and wherein when empty of bottles, opposite wall surface portions of each compartment are spaced at a distance slightly less than that of the corresponding width of a bottle to be received in that compartment.

2. A bottle tray as set forth in claim 1 wherein the inner cylinder of each pillar extends downwardly to the box bottom and an aperture in the box bottom is provided, the aperture circumscribing the inner cylinder, but located inward of the pillar side walls.

3. A bottle tray as set forth in claim 2 wherein side walls of each pillar are mutually connected by connecting members.

4. A bottle tray as set forth in claim 3 wherein connecting members extend between the box bottom and the pillar roof.

5. A bottle tray as set forth in claim 4 wherein the inner cylinder and connecting members of each pillar are each connected by a strut.

6. The bottle tray as s forth in claim 5 wherein the bottom of each compartment is provided with a collar.

7. The bottle tray as set forth in claim 6 wherein abutment means comprise tricuspids radially from the compartment bottom center.

8. The bottle tray as set forth in claim 1 wherein box bottom portions between bottle compartments are provided with apertures.

9. The bottle tray as set forth in claim 8 wherein each compartment bottom is encircled by a collar and each compartment bottom is provided with circumferentially spaced apertures, each spaced between the collar and compartment bottom center.

10. The bottle tray as set forth in claim 1 wherein the upper side of each compartment bottom is provided with bottle base abutment means which complement indentures of a loaded bottle base.

11. The tray as set fort in claim 1 wherein the pillar is structurally supported at its only.

12. The tray as set for in claim 11 wherein the pillar of a compartment flexes when an oversized bottle is inserted to the compartment.

13. The tray as set fort in claim 12 wherein each pillar is unconnected to the side walls.

* * * * *

UNITED STATES PATENT AND TRADEMARK OFFICE

CERTIFICATE OF CORRECTION

PATENT NO. : 4,928,841

DATED : May 29, 1990

INVENTOR(S) : R. Arthurs

It is certified that error appears in the above-identified patent and that said Letters Patent is hereby corrected as shown below:

Column 8:

In claim 6, line 1, change "s" to -- set --.

In claim 7, line 2, after "radially" insert -- spaced --.

In claim 11, line 2, after "its" insert -- base --.

Signed and Sealed this

Twenty-second Day of October, 1991

*Attest:*

HARRY F. MANBECK, JR.

*Attesting Officer*

*Commissioner of Patents and Trademarks*